United States Patent [19]

Bhagwat

[11] Patent Number: 4,924,920

[45] Date of Patent: May 15, 1990

[54] SEALING ARRANGEMENT FOR A TONER DISPENSING CARTRIDGE

[75] Inventor: Anil G. Bhagwat, Hemel Hempstead, United Kingdom

[73] Assignee: Xerox Corporation, Stamford, Conn.

[21] Appl. No.: 370,057

[22] Filed: Jun. 23, 1989

Related U.S. Application Data

[63] Continuation of Ser. No. 830,148, Feb. 18, 1986, abandoned.

[30] Foreign Application Priority Data

Dec. 11, 1985 [GB] United Kingdom ..... 8530466

[51] Int. Cl.[5] ..... B65B 1/04; G03G 15/08

[52] U.S. Cl. ..... 141/98; 141/364; 355/260; 222/DIG. 1; 222/325

[58] Field of Search ..... 141/1, 2, 18, 67, 89, 141/98, 346–348, 363–366, 384, 386; 222/DIG. 1, 325, 410; 220/217; 355/260

[56] References Cited

U.S. PATENT DOCUMENTS

| | | | |
|---|---|---|---|
| 1,498,367 | 6/1924 | Ferguson | 251/149 X |
| 3,618,826 | 11/1971 | Kangas | 222/DIG. 1 |
| 3,915,208 | 10/1975 | Anderson | 141/363 |
| 4,060,105 | 11/1977 | Feldeisen | 141/363 X |
| 4,062,385 | 12/1977 | Katusha et al. | 141/89 |
| 4,456,154 | 6/1984 | Herriman | 222/DIG. 1 |
| 4,491,161 | 1/1985 | Tamura et al. | 141/364 |
| 4,603,714 | 8/1986 | Marotta | 141/384 X |
| 4,615,364 | 10/1986 | Kawata | 141/364 |
| 4,650,070 | 3/1987 | Oka et al. | 222/DIG. 1 |

FOREIGN PATENT DOCUMENTS

| | | | |
|---|---|---|---|
| 0106569 | 4/1984 | European Pat. Off. . | |
| 0163262 | 10/1982 | Japan | 355/260 |
| 0097068 | 6/1983 | Japan | 355/260 |

*Primary Examiner*—Ernest G. Cusick

*Attorney, Agent, or Firm*—H. Fleischer; J. E. Beck; R. Zibelli

[57] ABSTRACT

An apparatus for dispensing material in which a housing is adapted to store a supply of material therein. The housing has an exit aperture for discharging the material therefrom. The exit aperture is sealed by inner and outer seals. The outer seal prevents access to the inner seal when the exit aperture is in a closed position. When the housing is moved from the closed position to an open position, the inner seal moves over the outer seal to an open position wherein the exit aperture is spaced from both the inner and outer seals so that material may be discharged therefrom.

7 Claims, 3 Drawing Sheets

SEALING ARRANGEMENT FOR A TONER DISPENSING CARTRIDGE

This is a continuation of application Ser. No. 06/830,148, filed Feb. 18, 1986 now abandoned.

This invention relates generally to an apparatus for dispensing particles from a cartridge which is particularly, although not exclusively, useful as a toner dispensing cartridge for an electrophotographic copying machine. More particularly, the cartridge is of the kind having a housing with an exit aperture closable by a sliding seal arrangement.

During the operation of a typical electrophotographic copying machine, toner particles are consumed as each electrostatic latent image is developed, and the developed image transferred to a copy sheet. The toner particles consumed are replenished, by adding new toner particles to a hopper or reservoir which is built into the machine from a cartridge storing a supply of toner particles therein. When the cartridge is empty, it is removed from the printing machine and a new, full cartridge placed therein.

Various types of devices have hereinbefore been developed for replenishing toner particles in an electrophotographic printing machine. The simplest ways include the use of a toner bottle with a screw cap or puncturable membrane, or a carton with an opening lid which forms a pouring spout. A more sophisticated form comprises a cartridge with an exit slot which receives a sliding seal. The cartridge is inserted into the machine, where the slot is sealingly engaged adjacent a toner receiving aperture, and the sliding seal is withdrawn. Once the cartridge is empty, the seal can be reinserted so as to re-seal the cartridge prior to its withdrawal. When the cartridge is empty, the seal can be reinserted to re-seal the cartridge prior to its withdrawal. An apparatus of the foregoing type is described more fully in U.S. Pat. No. 4,062,385 issued to Katusha et al. in 1977.

A major problem with known forms of containers is that the machine and its operator frequency become contaminated by toner particles escaping from the container or from the copying machine during a filling or a cartridge exchanging operation. Even in the case of the cartridge with the sliding seal, the seal itself is contaminated with toner particles so that on withdrawal of the seal toner particles may drop from it into the machine or onto the operator.

One way of solving this problem is to provide a receptacle in the machine which forms a sealing engagement with a toner container as the exit aperture of the container is introduced into the machine. One such arrangement is described in EP-A-No. 0 106 569. Although in that case the operator does not need to handle the seal or any part which may be contaminated with toner particles, there remains the problem that, as the container is withdrawn, its exit aperture is still carrying some toner particles which may possibly contaminate the operator, and which, unless the container is handled with extreme caution, are still liable to fall from the container.

The toner particle cartridge of the present invention is intended to solve the contamination problem encountered with known toner particles containers, and can be handled without danger of contamination, since all parts that are exposed to toner particles, while the cartridge is attached to the machine, are covered when the cartridge is withdrawn. The cartridge may equally easily be used either to load a particulate material into a hopper, or to provide a hopper which remains in place on a machine until it is empty. In either case, clean insertions and withdrawals are possible, with the risk of toner contamination virtually eliminated. Furthermore, if suitable seals are used, the cartridge may also be used for dispensing liquid materials.

In accordance with one aspect of the present invention, there is provided an apparatus for dispensing material. A housing is adapted to store a supply of material therein. The housing has an exit aperture for discharging the material therefrom. Means, adapted to be in communication with the exit aperture of the the housing in an open position, receive the material being discharged from the housing. Means are provided for sealing the exit aperture of the housing. The sealing means comprises an inner sliding seal and an outer sliding seal. The outer sliding seal covers and prevents access to the inner sliding seal when the sealing means is in a closed position. Means operate the sealing means to move the inner sliding seal relative to the outer sliding seal from the closed position to the open position wherein the exit aperture is spaced from the inner sealing means and the outer sealing means, and in communication with the receiving means for discharging material thereto.

Other aspects of the present invention will become apparent as the following description proceeds and upon reference to the drawings, in which.

Figure 1:
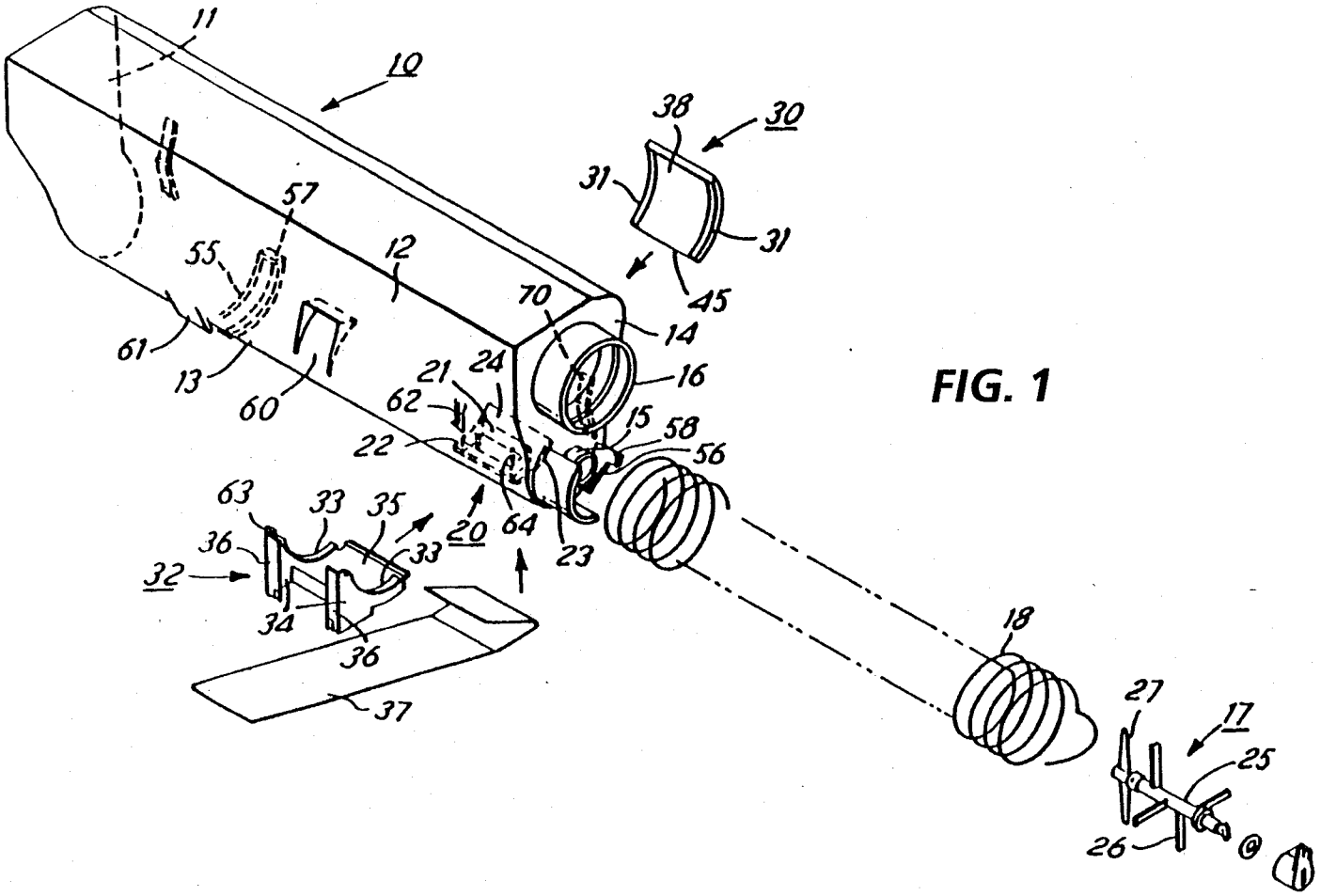
FIG. 1 is an exploded perspective view of a cartridge incorporating the features of the present invention therein for use in an electrophotographic printing machine.
Figure 2:
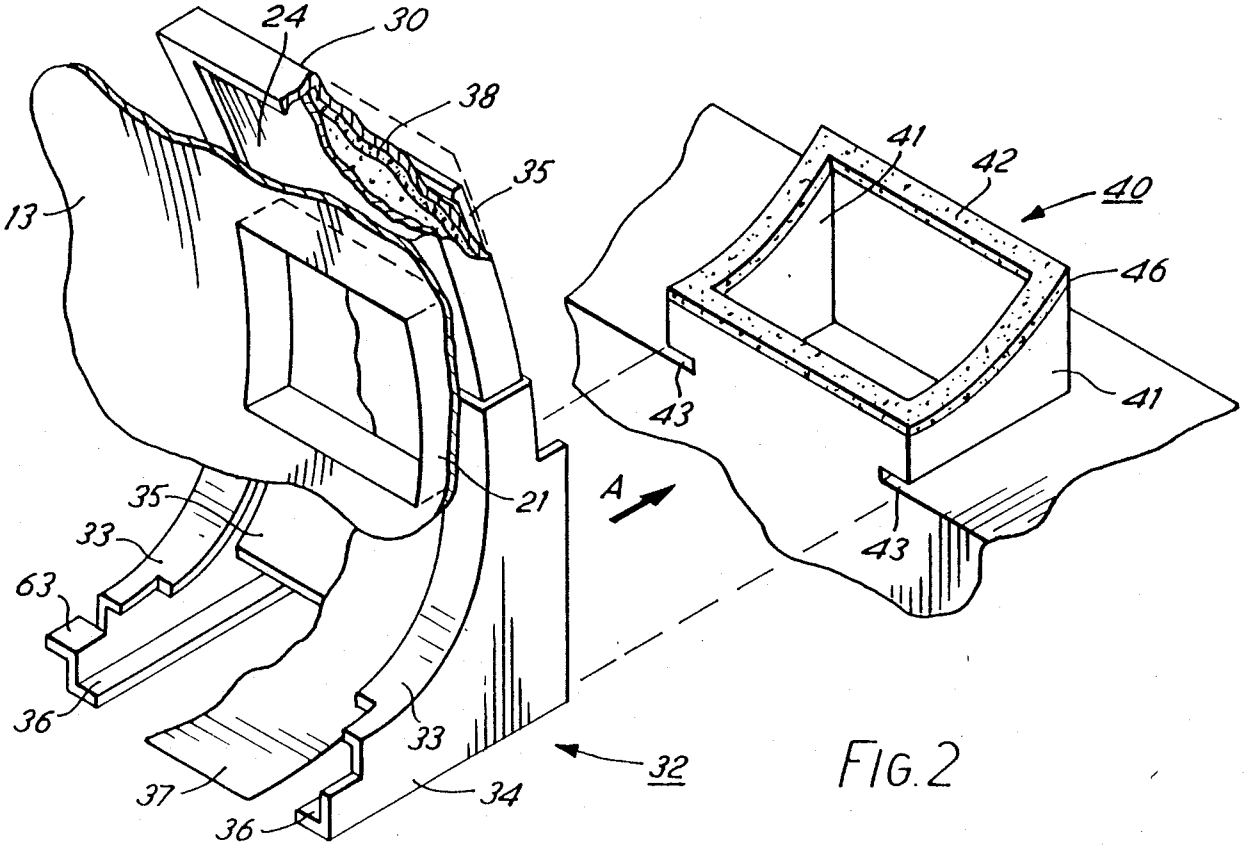
FIG. 2 is a fragmentary perspective view showing mating parts of the FIG. 1 cartridge and a receptacle, in the electrophotographic copying machine for receiving toner particles.

Referring now to FIGS. 1 and 2 of the drawings, the cartridge comprises an elongate housing 10, for example of a molded plastic material, which is closed at one end 11 and open at the other end. The upper portion 12 of the housing is of generally rectangular cross section, while the lower portion 13 is of substantially semi-cylindrical shape. The open end of the housing is closed by an end plate 14 which carries a bearing portion 15 and a filling collar 16. After the end plate 14 has been secured to the cartridge during manufacture, it is filled with toner particles through filling collar 16, which is then sealed. A drive assembly 17 is mounted in the bearing portion 15. An auger 18, in the form of a helical wire, is positioned within the lower portion 13 of the cartridge, and is arranged to be driven by drive assembly 17. The auger, on rotation during operation of the copying machine, pulls toner particles toward the end plate 14.

Toner particles are dispensed from the cartridge through an exit aperture 20 in the lower portion 13 of the housing, close to the end having the end- plate 14. The aperture 20 is rectangular, and opens into a rectangular open box structure 21 which extends downwardly from the housing to define a toner particle feed channel. The lower perimeter of the box 21 is provided with outwardly extending flanges. Two flanges 22, 23 extend towards the ends of the cartridge, and a third flange 24 extends laterally of the cartridge. The three flanges together define a curved surface substantially concentric with the lower portion 13 of the housing.

The drive assembly 17 consists of a shaft 25, and a set of blades 26 and resilient paddles 27 which are arranged so as to stir the toner particles in the region of the exit aperture 20, thereby preventing 'bridging' of the toner particles, and encouraging a regular outflow of toner particles from the housing. The paddles 27 are sufficiently long that their tips catch on the edges of aperture 20, thereby causing a 'flicking' action.

An inner seal 30 consists of a curved member having along its curved edges a pair of lip members 31 which define grooves adapted to engage the flanges 22 and 23 of the toner particle outflow box 21. The concave surface of the inner seal 30 is lined with a layer 38 of foam material. The width and curvature of the inner seal 30 are such that it is a sliding fit over the flanges of box 21. An outer seal 32 is shaped to slidingly engage over the inner seal 30, and includes two curved retaining members 33 which are formed on side members 34 and which, with a curved base member 35, form retaining channels for the outside surfaces of the lip members 31 of inner seal 30. The side members 34 of the outer seal are also provided with linear locating lips 36 for locating the outer seal 32, and hence the cartridge, in the copying machine as will be described below. A paper sealing strip 37 is also provided between the foam layer 38 and the flange 24 to give added protection to the toner during transportation and handling of the cartridge.

Referring now to FIG. 2, a toner particle receiver 40 of the copying machine (not shown) comprises an open-topped box arrangement the walls of which carry a foam sealing strip 42 along their top edges. The side walls 41 of the toner receiver have curved top edges adapted to cooperate with the curved surfaces of the seals 30 and 32 so that the top edges of the toner particle receiver form a sliding seal with the flanges 22, 23, 24 as the seals 30 and 32 are withdrawn from their positions covering the exit aperture 20 of the cartridge. The lower portions of side walls 41 have grooves 43 for engagement by the lip members 36 of the outer seal 32 as the cartridge is introduced into the machine.

Referring now to FIGS. 3 to 7, the successive figures illustrate the operation of the seals as the cartridge is inserted into, and withdrawn from, the copying machine.

Figure 7:
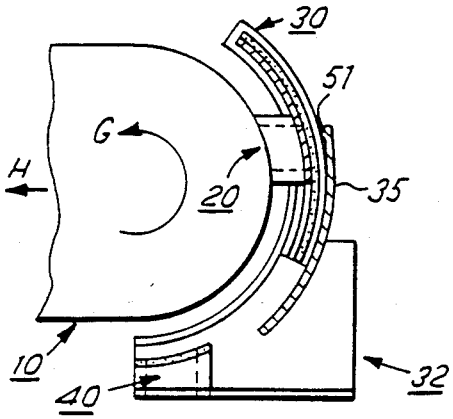
FIG. 7 is a sectional elevational view of the cartridge illustrating the action of the sealing arrangement with the cartridge in the closed position.

In order to insert the cartridge, it is introduced horizontally into the machine, i.e. with the walls of the box 21 in a horizontal position, as shown in FIG. 2, and the lips 36 of the outer seal 32 are engaged in the grooves 43 of the receiver 40. The cartridge is pushed into the machine (arrow A in FIG. 2) until the outer seal 32 reaches its 'home' position, i.e. as shown in FIG. 7. At this time, the inner seal 30 completely closes the exit aperture of the cartridge, with the curved base member 35 of the outer seal 32 covering the portion of the inner seal 30 which protrudes from the opposite edge of box 21 from the flange 24.

Figure 3:
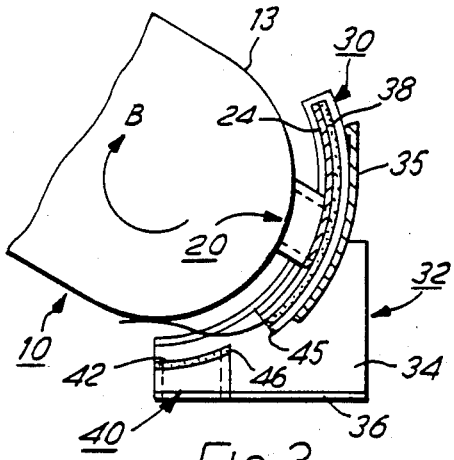
FIG. 3 is a sectional elevational view of the cartridge illustrating the action of the sealing arrangement as the cartridge moves from the closed position to the open position.

Once the cartridge is fully engaged, it is rotated bodily clockwise about its longitudinal axis, as shown by arrow B in FIG. 3, causing the inner seal 30 to initially move with it relative to the outer seal 32. Continued rotation brings the lower edge 45 of the inner seal 30 into contact with the top portion 46 of the rear wall of the toner receiver 40. Once this contact has been made, the flange 24 slides relative to the now fixed inner seal 30 until, when the cartridge is in the 'upright' position shown in FIG. 4, the exit aperture 20 is clear of the inner seal, and is located directly over the toner particle receiver 40. At this point, the paper seal 37, which extends from between the foam layer 38 and the flange 24, and which has its free end likely secured, for example, by adhesive, to the toner housing, is withdrawn as indicated by arrow C in FIG. 4. Alternatively, the paper seal 37 may be withdrawn before the cartridge is engaged in the receiver 40, i.e. as a preliminary step. Toner particles are then able to flow out of the cartridge through the exit aperture 20 and into the toner particle receiver 40, as indicated by arrows D in FIG. 4.

Toner particles are dispensed from the cartridge under gravity, with the assistance of the auger 18 and blades 26, 27 described above. When the cartridge is empty, it is removed by returning it to a horizontal position, and withdrawing it from the machine.

Figure 5:
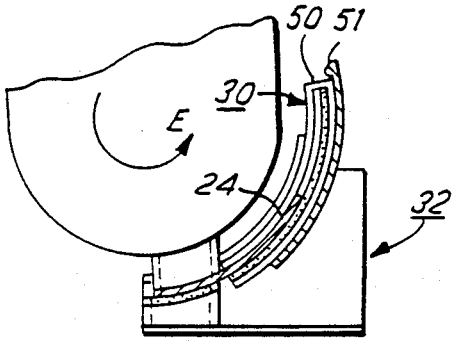
FIG. 5 is a sectional elevational view of the cartridge illustrating the action of the sealing arrangement in the open position after removal of the sealing strip.
Figure 6:
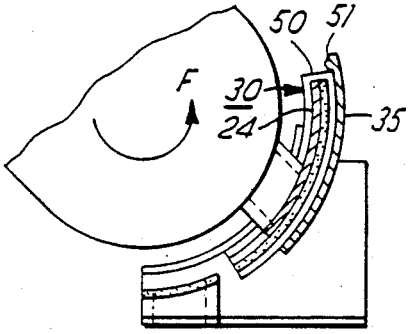
FIG. 6 is a sectional elevational view of the cartridge illustrating the action of the sealing arrangement as the cartridge returns to the closed position.

The initial stage of the return rotation is shown in FIG. 5, arrow E indicating the counterclockwise motion of the cartridge. The top edge 50 of the inner seal 30 immediately engages a protrusion 51 on the upper edge of the base 35 of the outer seal 32, thereby holding the inner seal in place, and causing the flange 24 to move relative to the inner seal 30. About halfway through the rotational movement of the cartridge, as shown in FIG. 6, the outer edge of the flange 24 contacts the inside of the top edge 50 of the inner seal 30. Further rotation, as indicated by arrow F in FIG. 6 and arrow G in FIG. 7 causes the inner seal 30 to force its way past the protrusion 51 of the outer seal 32 (the base 35 of outer seal 32 being of resilient plastics material). Finally, when the cartridge has been returned to the horizontal position, as shown in FIG. 7, it is withdrawn as shown by arrow H.

In addition to the main features of the cartridge described above, a number of detailed features are provided to ensure reliable operation of the cartridge. Referring to FIG. 1, a first arcuate guide 55 is provided on the body of the cartridge, with a second arcuate guide 56 on the end- plate 14. A closed end 57 of the first arcuate guide 55 provides an end stop, and an end stop of the second arcuate guide 56 is provided by a protrusion 58. In order to assist the initial location of the cartridge in the machine, a recess 60 is provided in the mid-portion of the semi-cylindrical lower portion 13 of the housing. The recess 60 provides a short continuation of the cylindrical surface which forms the lower portion 13, and is arranged to cooperate with a suitably shaped member on the machine. A stop tab 61 is provided near the arcuate guide 55 to arrest the rotational movement of the cartridge when the cartridge is rotated prior to removal.

A latch 62 (FIG. 1) is provided adjacent the end of one of the side members 34 of outer seal 32, the end of the side member 34 being the one remote from the protrusion 51 of the outer seal. The latch 62 cooperates with a sideways protrusion 63 on this end of the side member 34. The latch 62 consists of a resilient arm with a latching head, and holds the seal arrangement in the closed position. A firm rotation of the housing is sufficient to unlatch the outer seal 32 against the resiliency of the latch arm.

The outer seal 32 is prevented from rotation beyond its proper closed position by means of two buffers 64 positioned to engage stepped end sections of the curved retaining members 33. The buffers stop the outer seal 32 in the position where it has just been engaged by the latch 62. Another way of preventing undue movement of the outer seal 32, which may be used as well as, or instead of, the buffers 64, is the provision of a recess in the outer surface of the inner seal 32, which is engaged by the protrusion 51 of the outer seal 32.

Figure 8:
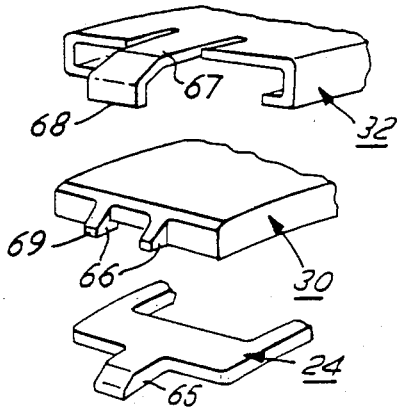
FIG. 8 is an exploded, fragmentary perspective view of an alternate embodiment of the mechanism for locking the cartridge outer and inner seals to one another.

An alternative, and preferred, form of locking mechanism for locking the outer seal to the inner seal will now be described with reference to FIG. 8. This alternative locking mechanism replaces the protrusion 51 on the outer seal 32 by a more positive latching and unlatching mechanism. The outer end of the hopper flange 24 is formed with a chamfered tongue 65. The outer edge of the inner seal 30 is formed with a pair of locating tabs 66, and the outer edge of the outer seal 32 is provided with a resilient extension forming a latch member 67, having a depending portion 68 adapted to latch over the locating tabs 66. In the latch position, the depending portion 68 of latch member 67 contacts the end faces 69 of the locating tabs 66. This arrangement provides a positive drive of the inner seal by the outer seal, or vice versa. The latch member 67 is disengaged from the inner seal by the tongue 65, when the cartridge is being removed and is in the position shown in FIG. 6. The tongue 65 is pushed between the locating tabs 66 to force the portion 68 of latch member 67 off the end faces 69 of tabs 66, whereafter the depending portion 68 of latch member 67 rides over the outer surface of the inner seal 30.

Figure 4:
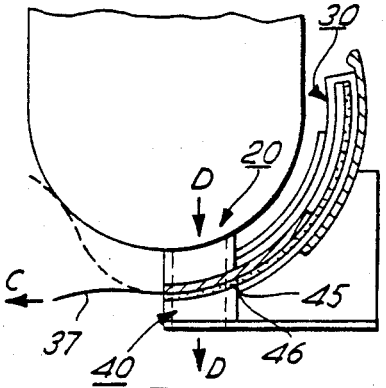
FIG. 4 is a sectional elevational view of the cartridge illustrating the action of the sealing arrangement in the open position prior to removal of the sealing strip.

A pair of resilient locking members 68 are provided on the rear wall (as seen in FIG. 1) of the upper portion 12 of the housing 10. These locking members are positioned so as to clip the cartridge into place on the machine as it is rotated into its operative position (FIG. 4). The locking members are manually released in order to remove the cartridge.

As will be seen from the above, at no time during insertion, operation or withdrawal of the cartridge are any of the toner-contaminated parts accessible to the operator. Furthermore, when the cartridge is removed, the outer seal prevents access to the contaminated portion of the inner seal.

Although the cartridge described uses arcuate seals, the invention is equally applicable to planar seals, in which case linear insertion and withdrawal movements are made, rather than the rotational movements of the cartridge described above. In this case, the seals can be arranged for sliding movement either laterally or longitudinally of the cartridge, depending on how the cartridge is best introduced into the copying machine.

It is, therefore, evident that there has been provided an apparatus for discharging material which full satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for dispensing material including:

a housing adapted to store a supply of material therein, said housing having an exit aperture for discharging the material therefrom;

means, adapted to be in communication with the exit aperture of said housing in an open position, for receiving the material being discharged from said housing;

means for sealing the exit aperture of said housing, said sealing means comprising a rigid inner sliding seal and a rigid outer sliding seal, said outer sliding seal covering and preventing access to said inner sliding seal covering the exit aperture when said sealing means is in a closed position and said inner sliding seal and said outer sliding seal being spaced from the exit aperture providing access to the exit aperture when said sealing means is in an open position, said housing, on insertion into a location where the exit aperture thereof is in communication with said receiving means, operating said sealing means to move said inner sliding seal and said outer sliding seal relative to one another from the closed position to the open position wherein the exit aperture is in communication with said receiving means for discharging material into said receiving means, and on removal of said housing from a position where the exit aperture thereof is in communication with said receiving means, said housing operating said sealing means to move said inner sliding seal and said outer sliding seal relative to one another from the open position to the closed position where said outer sliding seal covers said inner sliding seal preventing access to said inner sliding seal.

2. An apparatus according to claim 1, further including a flange member mounted adjacent the exit aperture of said housing with said inner seal being slidingly engaged thereover.

3. An apparatus according to claim 2, further including an open-box structure surrounding the exit aperture of said housing with said flange member extending outwardly therefrom.

4. An apparatus according to claim 3, wherein said outer seal is slidingly engaged over said inner seal.

5. An apparatus for dispensing material including:

a housing adapted to store a supply of material therein, said housing having an exit aperture for discharging the material therefrom;

means, adapted to be in communication with the exit aperture of said housing in an open position, for receiving the material being discharged from said housing;

means for sealing the exit aperture of said housing, said sealing means comprising an inner sliding seal and an outer sliding seal, said outer sliding seal covering and preventing access to said inner sliding seal covering the exit aperture when said sealing means is in a closed position and said inner sliding seal and said outer sliding seal being spaced from the exit aperture providing access to the exit aperture when said sealing means is in an open position;

means for operating said sealing means to move said inner sliding seal relative to said outer sliding seal from the closed position to the open position wherein the exit aperture is spaced from said inner seal and said outer seal, and in communication with said receiving means for discharging material thereto, said operating means moves said sealing means from the closed position to the open position on insertion of said housing into a location where the exit aperture thereof is in communication with said receiving means, and on removal of said housing from a position where the exit aperture thereof is in communication with said receiving means, said operating means moves said sealing means from the open position to the closed position; and a flange member mounted adjacent the exit aperture of said housing with said inner seal being slidingly engaged thereover, an open-box structure surrounding the exit aperture of said housing with said flange member extending outwardly therefrom, said outer seal being slidingly engaged over said inner seal, said flange member comprises an arcuate flange member, said inner seal comprises an arcuate inner seal, and said outer seal comprises an arcuate outer seal so that insertion and removal of said housing requires rotational movement thereof.

6. An apparatus according to claim 5 wherein:

said housing includes engagement means; and said receiving means includes a locating means for engaging said engagement means so that when said engagement means and said locating means are in engagement with one another rotation of said housing causes said outer and inner sliding seals to be operated successively.

7. An apparatus according to claim 6, wherein said receiving means includes a stop member so that said inner seal remains substantially fixed relative to the exit aperture of said housing during rotation thereof with said inner seal sliding within said outer seal until arrested by said stop member so that further rotation of said housing moves the exit aperture to the open position.

* * * * *